US005934559A

United States Patent [19]

Coldren et al.

[11] Patent Number: 5,934,559

[45] Date of Patent: Aug. 10, 1999

[54] ELECTRONIC FUEL INJECTOR WITH INTERNAL SINGLE-POLE SOLENOID AND CENTER FLOW POST

[75] Inventors: Dana R. Coldren, Fairbury; Marvin P. Schneider, East Peoria, both of Ill.; Colin T. Timms, Harrow Weald, United Kingdom

[73] Assignees: Caterpillar Inc.,, Peoria, Ill.; Lucas Industries PLC, Solihull, United Kingdom

[21] Appl. No.: 08/963,333

[22] Filed: Nov. 3, 1997

[51] Int. Cl.[6] ..... F02M 47/02

[52] U.S. Cl. ..... 239/88; 239/95; 239/533.9; 239/585.1; 251/129.21

[58] Field of Search ..... 239/585.1–585.5, 239/900, 533.9, 88, 89, 90, 95; 251/129.15, 129.21

[56] References Cited

U.S. PATENT DOCUMENTS

| | | | |
|---|---|---|---|
| 4,436,247 | 3/1984 | Akagi | 239/533.9 X |
| 4,627,571 | 12/1986 | Kato et al. | 239/90 |
| 5,094,215 | 3/1992 | Gustafson | 239/89 X |
| 5,127,583 | 7/1992 | Taue | 239/533.9 X |
| 5,628,293 | 5/1997 | Gibson et al. | 123/446 |
| 5,673,853 | 10/1997 | Crofts et al. | 239/88 |
| 5,699,963 | 12/1997 | Ueda | 239/585.3 X |

FOREIGN PATENT DOCUMENTS

| | | | |
|---|---|---|---|
| 2 114 658 | 8/1983 | United Kingdom . | |
| 2114658 | 8/1983 | United Kingdom | F02M 47/00 |
| 2 320 289 | 6/1998 | United Kingdom . | |
| 2320289 | 6/1998 | United Kingdom | F02M 57/02 |

OTHER PUBLICATIONS

U.K. Search Report dated Dec. 10, 1998; Appl. No. GB 9820424.1.

*Primary Examiner*—Andres Kashnikow
*Assistant Examiner*—Steven J. Ganey
*Attorney, Agent, or Firm*—William E. McCracken; Marshall, O'Toole, Gerstein, Murray & Borum

[57] ABSTRACT

A fuel injector includes a valve member disposed at the upper end of the injector case adjacent a valve recess. The valve member includes a bore and a counterbore, and a tube having a bore is slidably disposed within the counterbore. The valve member bore and the tube bore define a fuel flow passage substantially coincident with the central axis of the injector. The valve member is spring biased to an open position to communicate fuel at transfer pump pressure to the valve recess. At the initiation of the injection cycle, an actuator, preferably an electrical solenoid, closes the valve against the spring force so that fuel is communicated along the central passage to a nozzle.

16 Claims, 3 Drawing Sheets

ELECTRONIC FUEL INJECTOR WITH INTERNAL SINGLE-POLE SOLENOID AND CENTER FLOW POST

TECHNICAL FIELD

The present invention relates generally to fuel injection apparatus, and more particularly to a fuel injector having one or more components that conduct fuel down the center of the injector.

BACKGROUND ART

Fuel injected engines employ fuel injectors, each of which delivers a metered quantity of fuel to an associated engine cylinder during each engine cycle. Prior fuel injectors were of the mechanically or hydraulically actuated type with either mechanical or hydraulic control of fuel delivery. More recently, electronically controlled fuel injectors have been developed. In the case of an electronic unit injector, fuel is supplied to the injector by a transfer pump. The injector includes a plunger which is movable by a cam-driven rocker arm to compress the fuel delivered by the transfer pump to a high pressure. An electrically operated mechanism either carried outside the injector body or disposed within the injector proper is then actuated to cause fuel delivery to the associated engine cylinder.

In prior fuel injector designs, high pressure fuel is conducted through passages which are located outside of a central recess containing a solenoid which operates a valving mechanism. The passages are located close to the outer surface of the fuel injector and are formed by drilling intersecting holes. After drilling, portions of some of the holes must be filled with plugs. These passages and plugs are subjected to very high fluid pressures, thus requiring careful design and increasing complexity and cost.

In addition to the foregoing, because the high pressure passages are located outside of the solenoid, the size of the solenoid is necessarily limited, thereby limiting the available solenoid force.

Still further, a prior type of fuel injector utilizes a cartridge valve mounted outside of the injector body. This cartridge valve adds significantly to the size and cost of the overall injector.

SUMMARY OF THE INVENTION

The fuel injector apparatus according to the present invention effectively eliminates drawbacks in prior art fuel injectors including those mentioned above. The center flow post design permits the use of a larger solenoid or other electronic actuator which maximizes the available solenoid force resulting in improved response. Moreover, the use of flat seat valves renders the alignment of the various injector components less critical resulting in a more cost affective unit. The center flow post design also eliminates the need for the drilled and plugged high pressure passages outlined above resulting in increased performance and reliability.

According to one aspect of the invention an injector case includes a barrel, a valve body and a lower stop and defines a central valve recess. The injector includes a fuel chamber passage in fluid communication with a plunger cavity and a fuel outlet passage in flow communication with a nozzle assembly. A valve member is disposed within the valve recess and is shiftable between a first or closed position in which one end of the valve member is biased against the upper portion of the valve body, which isolates the fuel pumping chamber passage from the recess and which permits the fuel from the pumping chamber passage to flow through a bore in the valve member. The other end of the valve member includes a counterbore which slidably receives an end of a tube therein. A bore in the tube is in fluid communication with the valve member bore, thereby communicating fuel from the pumping chamber passage to the fuel outlet passage. An actuator is connected to the valve member for moving the valve member from an open position in which fuel flows through the valve recess, to a closed position in which fuel flows from the pumping chamber passage through the valve member and tube, and into the outlet passage.

Preferably, the valve member comprises a flat-seat poppet valve. Also preferably, the actuator comprises a solenoid which may include an armature surrounding the center tube and coupled to the valve member. Still further in accordance with the preferred embodiment, the valve member is biased toward the open position by a valve spring.

According to another aspect of the invention an injector case defines a valve recess and includes a pumping chamber passage in communication with the plunger cavity and a fuel outlet passage in communication with a nozzle. An extensible valve member is disposed in the valve recess and includes a first end adjacent the lower portion of the injector barrel and a second end adjacent the upper portion of the lower stop. A bore extends through the valve member. The extensible valve is shifted between a closed position wherein the valve member first end is biased against the adjacent lower portion of the injector barrel, thereby isolating the pumping chamber passage from the recess, and an open position in which the pumping chamber passage is in fluid communication with the recess. An actuator moves the extensible valve into the closed position thereby routing fuel from the pumping chamber passage through the extensible valve bore and out the outlet passage.

According to yet another aspect of the invention, a fuel injector includes an injector case defining a central axis and enclosing a valve recess. A fuel pumping chamber passage is substantially coincident with the central axis and is in flow communication with a plunger cavity. A valve member is disposed in the valve recess and has a bore extending therethrough. A counterbore adjacent one end of the valve member slidably receives a tube, and the valve member is shiftable between a closed position wherein the fuel from the pumping chamber passage is isolated from the recess and fuel flows through the valve, the tube, and through an outlet passage to a nozzle, and an open position wherein the fuel from the pumping chamber passage is in flow communication with the recess. An actuator is coupled to the valve member to shift the valve member to the closed position.

BEST MODE FOR CARRYING OUT THE INVENTION

Figure 1:
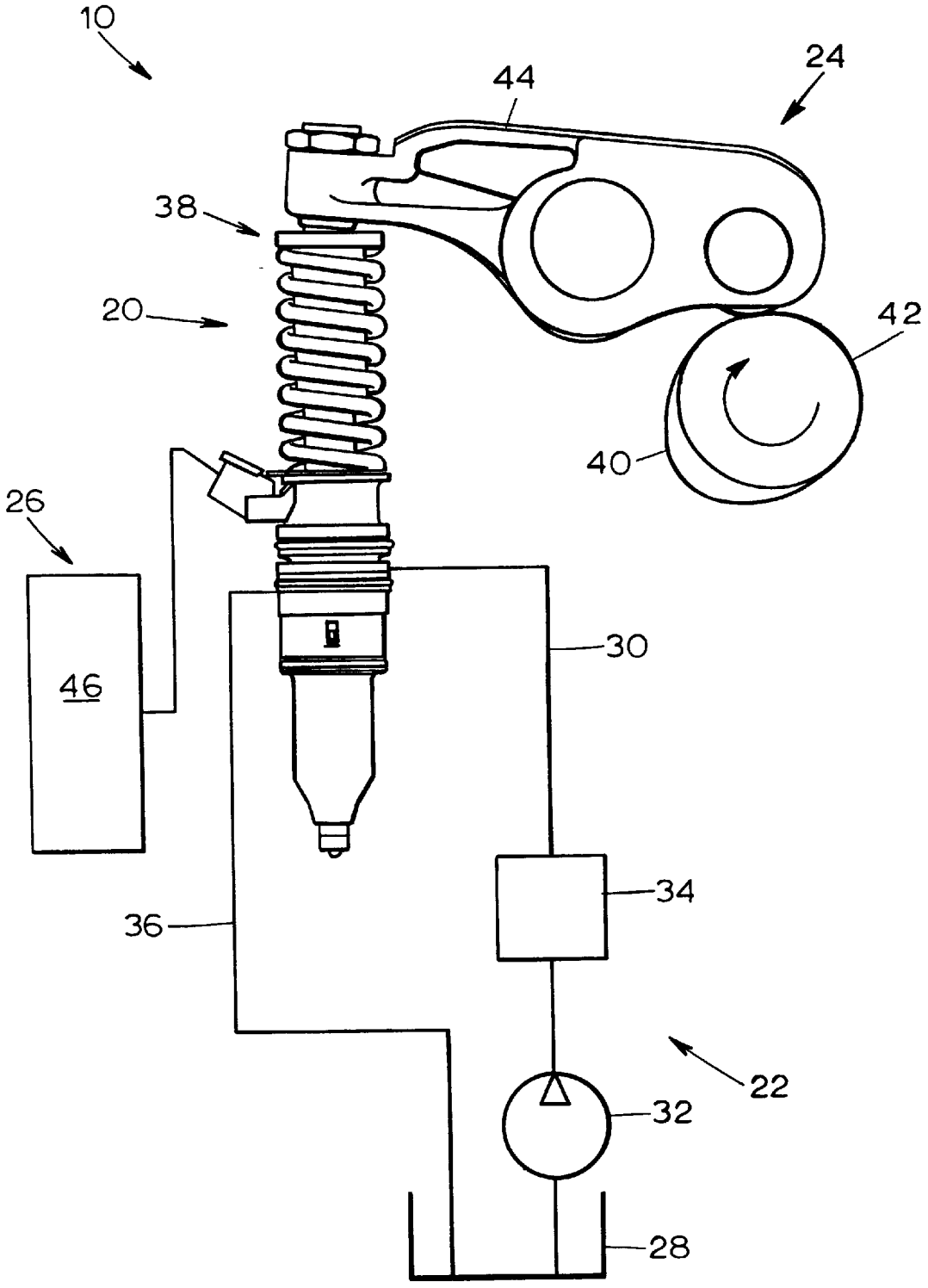
FIG. 1 is an elevational view of a fuel injector incorporating the present invention together with a cam shaft and rocker arm and further illustrating a block diagram of a transfer pump and a drive circuit for controlling the fuel injector.

Referring now to FIG. 1 of the drawings, a portion of the fuel system 10 is shown adapted for a direct-injection diesel-cycle reciprocating internal combustion engine. However, it should be understood that the present invention is also applicable to other types of engines, such as rotary engines or modified-cycle engines and that the engine may contain one or more engine combustion chambers or cylinders. The engine has at least one cylinder head wherein each cylinder head defines one or more separate injector bores, each of which receives an injector 20 according to the present invention. The fuel system 10 further includes an injector supply system 22 for supplying fuel to each injector 20, a pressurizing system 24, and an electronic control system 26.

The fuel supply 22 preferably includes a fuel tank 28, a fuel supply passage 30 arranged in fluid communication between the fuel tank 28 and the injector 20, a relatively low pressure fuel transfer pump 32, one or more fuel filters 34 and a fuel drain passage 36 arranged in fluid communication between the injector 20 and the fuel tank 28. If desired, fuel passages may be disposed in the head of the engine in fluid communication with the fuel injector 20 and one or both of the passages 30 and 36.

The fuel pressurizing system 24 may be any mechanically-actuating device or hydraulically-actuating device. In embodiment shown a tappet and plunger assembly 38 associated with the injector 20 is mechanically-actuated directly or indirectly by a cam lobe 40 of cam shaft 42. The cam lobe 40 drives a pivoting rocker arm 44 which in turn reciprocates the tappet and plunger assembly 38. Alternatively, a push rod (not shown) may be positioned between the cam lobe 40 and the rocker arm 44, or the cam shaft 42 may be located such that the cam lobe 40 directly operates the tappet and plunger assembly 38.

The electronic control system 26 preferably includes an electronic control module (ECM) 46 which controls: (1) fuel injection timing; (2) total fuel injection quantity during an injection cycle; (3) the number of separate injection segments during each injection cycle; (4) the time interval(s) between the injection segments; and (5) the fuel quantity delivered during each injection segment of each injection cycle.

Preferably, each injector 20 is a unit injector which includes in a single housing apparatus for both pressurizing fuel to a high level (for example, 207 MPa (30,000 p.s.i.)) and injecting pressurized fuel into an associated cylinder. Although shown as a unitized injector 20, the injector 20 could alternatively be of a modular construction wherein the fuel injection apparatus is separate from the fuel pressurization apparatus.

Figure 2:
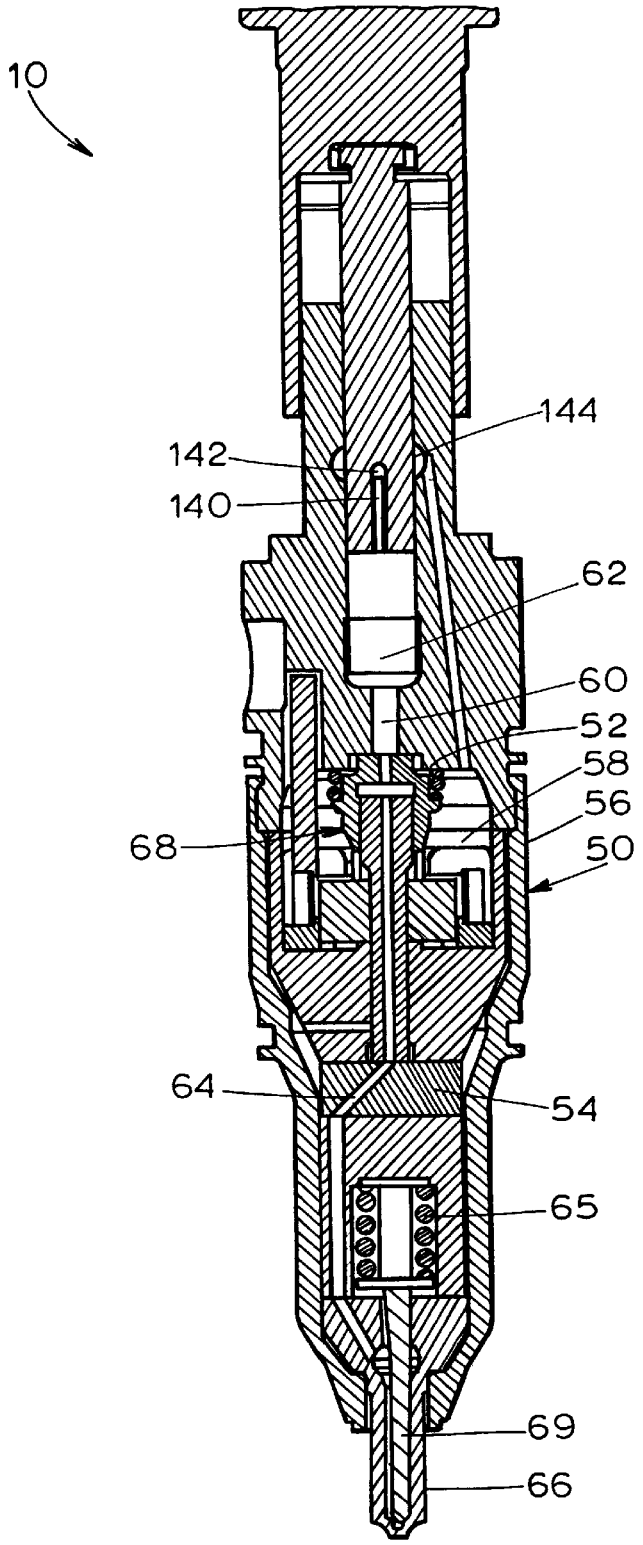
FIG. 2 is a fragmentary cross-sectional view of the fuel injector of FIG. 1.
Figure 3:
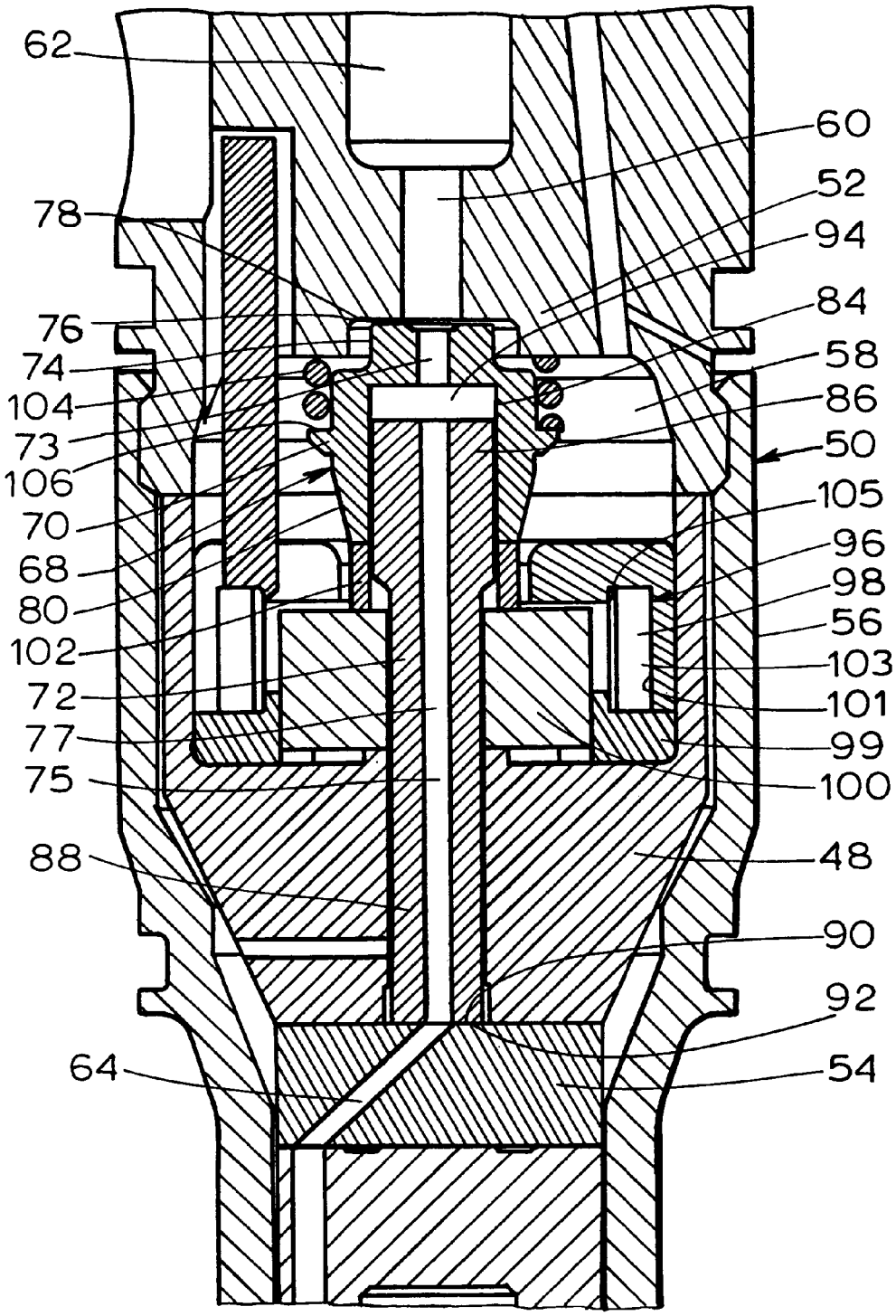
FIG. 3 is an enlarged fragmentary cross-sectional view of the fuel injector shown in FIG. 2 illustrating the solenoid and spill valve in greater detail.

Referring now to FIGS. 2 and 3, the injector 20 includes a case 50 having a barrel portion 52, a lower stop 54, and a valve body 48 with an interconnecting sidewall 56. Sidewall 56 encloses a valve recess 58. A fuel pumping chamber passage 60 communicates pressurized fuel from a plunger cavity 62. A fuel outlet passage 64 in the lower stop 54 communicates fuel to a nozzle 66. Valve assembly 68 includes a valve member 70 and a tube 72. Valve member 70 includes a first end 74 having a sealing surface 76 spaced from a valve seat 78, and further includes a second end 80. A bore 73 extends between the ends 74, 80. Valve member 70 further includes a counterbore 84 adjacent the second end 80.

Tube 72 includes a first end 86 and a second end 88 having a sealing surface 90 spaced from a seat 92, and further includes a bore 75 extending between first and second ends 86, 88. First end 86 of tube 72 is slidably disposed within counterbore 84 of valve member 70, and has a match clearance fit within counterbore 84 thereby defining a chamber 94 therebetween. The projected area of first end 86 of tube 72 is greater then the projected area of second end 88, thereby allowing fuel pressure within chamber 94 to bias tube 72 downwardly, thus closing sealing surface 90 against seat 92. Alternatively, tube 72 could be permanently secured to the lower stop 54. Bore 73 of valve member 70 cooperates with bore 75 of tube 72 to define a central fuel passage 77.

An electrical actuator 96 is concentrically disposed within recess 58 for controlling the valve assembly 68. Actuator 96 includes a solenoid 98. The solenoid 98 includes a stator 99 having a recess 101 within which is disposed a solenoid coil 103 wound on a bobbin 105. The armature 100 surrounds and is axially movable with respect to the center tube 72. A spacer 102 is disposed between first valve member 70 and armature 100. A spring 104 abuts an annular shoulder 106 on valve member 70, thus biasing sealing portion 76 away from seat 78.

INDUSTRIAL APPLICABILITY

In operation, at the beginning of an injection sequence the solenoid 98 is unenergized, and the first valve member 70 is biased away from the barrel 52 by spring 104. Fuel is supplied at transfer pump pressure to the injector, and flows into recess 58 through passages (not shown), across valve seat 76 through passage 60 to the plunger cavity 62 and through passages 140, 142 to an annular groove 144 (elements 140, 142, 144 are shown in FIG. 2) which is in fluid communication with drain.

Subsequently, the lobe 40 on cam shaft 42 pushes against the rocker arm 44, which forces the tappet and plunger assembly 38 downwardly, thus pressurizing fuel within the plunger cavity 62. At a designated point in time a suitable waveform is supplied to solenoid 98, and the armature 100 moves upwardly relative to the stationary tube 72. The action of armature 100 against spacer 102 urges first valve member 70 upwardly against the force of spring 104, which forces sealing surface 76 against seat 78, thus isolating the fuel passage 60 from the valve recess 58. At the same time, the fuel pressure within chamber 94 maintains the end 88 of tube 72 in contact with the sealing surface 92 at the upper of lower stop 52 so that fuel within passage 77 is communicated to outlet passage 64. Fluid pressurized by downward movement of the tappet and plunger assembly 38 is thus delivered through valve assembly 68 via passage 77 and through the outlet passage 64 to nozzle 66. When the fuel pressure in the nozzle 66 exceeds the valve opening pressure (VOP) a check 69 in nozzle 66 opens against the force of the spring 65, and fuel is delivered to the cylinder.

When injection of fuel into the cylinder is to be terminated, the current delivered to solenoid 98 is reduced or eliminated. Spring 104 urges the valve member 70 away from the barrel 52 which causes the armature 100 to return to its original position. The force of spring 104 immediately causes the valve member 70 to return to its open position with the sealing surface 76 spaced away from the seat 78. The pressurized fuel in passage 60 spills into recess 58, and the pressurized fuel in chamber 94, passage 77 and passage 66 flows into recess 58 to drain. The reduced fuel causes check 69 to become unbalanced, allowing the check spring 65 to close the check 69. With the valve member 70 in the open position, the fuel in the pumping chamber passage 60, which is no longer isolated from the recess 58, consequently spills into the recess 58 and to drain.

Alternatively, multiple or split injections per injection cycle can be accomplished by supplying suitable actuating signals from the ECM 46 to the electrical actuator 96. Moreover, it should be evident from the foregoing that the central passage 77 is substantially coincident with the central axis of the fuel injector 20 and is aligned at first and second ends with the pumping chamber passage 60 and outlet passage 64, respectively. Because fuel is directed along the center of the injector, high pressure intersecting holes and plugs are not required. Further, the solenoid 98 can have a larger diameter, thereby allowing the actuator 96 to develop higher forces, which in turn improves injector operation and response.

Numerous modifications and alternative embodiments of the present invention will be apparent of those skilled in the art in view of the foregoing description. Accordingly, this description is to be construed as illustrative only and is only for the purpose of teaching those skilled art the best mode of carrying out the invention. The details of the structure and/or function may be varied substantially without departing from the spirit of the invention, and the exclusive use of all modifications which come within the scope of the appended claims is reserved.

We claim:

1. A fuel injector, comprising:

an injector case defining a valve recess and having a barrel and a lower stop and having a pumping chamber passage in flow communication with a plunger cavity;

a fuel outlet passage in flow communication with a nozzle;

a valve member disposed in said valve recess, said valve member having a first end, a second end, a bore extending between said first and second ends, and a counterbore adjacent said second end, said valve member being shiftable between a closed position with said first end biased against the barrel wherein said pumping chamber passage is isolated from said recess and an open position wherein said pumping chamber passage is in flow communication with said recess;

a tube having a first end, a second end, and a bore extending between said first and second ends, said tube first end being slidably disposed in said valve member counterbore with said tube bore in flow communication with said valve member bore and further being in flow communication with said outlet passage; and an actuator for moving said valve member towards said closed position.

2. The fuel injector of claim 1, wherein said valve member first end is a flat-seated poppet valve.

3. The fuel injector of claim 1, wherein said valve member is biased towards said open position by a spring.

4. The fuel injector of claim 1, wherein said actuator includes a solenoid.

5. The fuel injector of claim 4, wherein said solenoid includes an armature coupled to said valve member.

6. The fuel injector of claim 1, wherein said second end of said tube is a flat-seat poppet valve and further wherein the surface area of said tube first end is greater than the surface area of said tube second end, said tube being biased towards a seated position against said lower stop.

7. The injector of claim 1, including a drain passage adjacent said tube second end.

8. A fuel injector, comprising:

an injector case defining a valve recess and having a barrel, a lower stop, and a pumping chamber passage through said barrel in flow communication with a plunger cavity;

a fuel outlet passage through said lower stop in flow communication with a nozzle;

an extensible valve disposed in said valve recess, said extensible valve having a first end, a second end, a bore extending between said first and second ends in flow communication with said outlet pass-age, said extensible valve being shiftable between a closed position with said first end biased against said barrel wherein said pumping chamber passage is isolated from said recess, and an open position wherein said pumping chamber passage is in flow communication with said recess, wherein said extensible valve further includes a first member coupled to said actuator and having a counterbore, and a second member comprising a tube slidably disposed in said first member counterbore, said first member being biased towards said closed position by a spring; and an actuator for moving said extensible valve towards said closed position.

9. The fuel injector of claim 8, wherein said first end includes a flat-seated poppet valve.

10. The fuel injector of claim 8, wherein said tube includes a first end and a second end defining said extensible valve second end, the projected area of said tube first end being greater than the projected area of said tube second end, said tube being biased by fuel pressure to a seated position with said valve member second end seated against the lower stop.

11. The fuel injector of claim 8, wherein said actuator includes a solenoid.

12. The fuel injector of claim 11, wherein said solenoid includes an armature coupled to said extensible valve.

13. The fuel injector of claim 8, wherein said actuator exerts a force greater than said spring.

14. The fuel injector of claim 8, wherein said case defines a central axis and said bore is coincident with said central axis.

15. The fuel injector of claim 14, wherein said actuator surrounds said central axis.

16. A fuel injector, comprising:

an injector case defining a central axis and enclosing a valve recess;

a pumping chamber passage substantially coincident with the central axis and being in flow communication with a plunger cavity;

a fuel outlet passage in flow communication with a nozzle;

a valve member disposed in said valve recess, said valve member having a first end, a second end, a bore extending between said first and second ends, and a counterbore adjacent said second end, said valve member being shiftable between a closed position wherein said pumping chamber passage is isolated from said recess and an open position wherein said pumping chamber passage is in flow communication with said recess;

a tube having a first end, a second end, and a central passage substantially coincident with said central axis and being in flow communication with said valve member bore and said fuel outlet passage, said first end being received in said valve member for relative movement therebetween; and an actuator coupled to said valve member for moving the valve member towards said closed position.

* * * * *